United States Patent [19]

Kimura

[11] Patent Number: 4,722,281

[45] Date of Patent: Feb. 2, 1988

[54] INTERMITTENT EXPLOSION APPARATUS AND METHOD OF USING SUCH APPARATUS

[75] Inventor: Shuzo Kimura, Ichikawa, Japan

[73] Assignees: Yachiyoda Sangyo Co., Ltd., Tokyo; Yachiyoda Kogyo Co., Ltd., Chiba, both of Japan

[21] Appl. No.: 918,153

[22] Filed: Oct. 14, 1986

[30] Foreign Application Priority Data

Oct. 17, 1985 [JP] Japan ..... 60-157789[U]

[51] Int. Cl.[4] ..... F42B 1/02

[52] U.S. Cl. ..... 102/305; 102/321; 89/33.2

[58] Field of Search ..... 102/305, 317, 321; 89/33.1, 33.02; 128/24 A, 305, 328

[56] References Cited

U.S. PATENT DOCUMENTS

| | | | |
|---|---|---|---|
| 2,821,921 | 2/1958 | Martin | 102/317 X |
| 2,999,458 | 9/1961 | Coursen | 102/305 |
| 3,088,378 | 5/1973 | Boudreau | 89/33.02 |
| 3,687,074 | 8/1972 | Andrews et al. | 102/305 X |
| 3,720,133 | 3/1973 | Jampy et al. | 89/126 |
| 4,605,003 | 8/1986 | Oinuma et al. | 128/328 |
| 4,620,545 | 11/1986 | Shene et al. | 128/328 |

FOREIGN PATENT DOCUMENTS 2724324 8/1978 Fed. Rep. of Germany .

*Primary Examiner*—Peter A. Nelson

*Attorney, Agent, or Firm*—Sandler & Greenblum

[57] ABSTRACT

The present invention relates to an apparatus for providing intermittent explosion of a plurality of explosive charges initially attached to an explosive capsule support belt. The belt is indexed so that a plurality of spaced capsules on the belt can be separated from the belt by generally vertical movement of an explosive capsule holding rod and then detonated within a shock wave generating chamber which has at least part of its interior surface area which in the shape of a pseudo-ellipsoid. The belt comprises two spaced members which are attached to each other by a plurality of reinforcing rods, with a plurality of capsules being positioned between the base members in a first direction and between the reinforcing rods in a second direction; the capsules are held to the base members by attaching rods which extend from opposed base members.

26 Claims, 5 Drawing Figures

INTERMITTENT EXPLOSION APPARATUS AND METHOD OF USING SUCH APPARATUS

BACKGROUND OF THE INVENTION

1. Field of the Invention

The present invention generally relates to an apparatus for exploding explosive devices in an intermittent fashion to generate shock waves in a successive fashion, and more specifically to such an apparatus which is adapted to be used to disintegrate calculus or calculi in a human body.

2. Discussion of Prior Art

The present applicant has previously proposed apparatus for disintegrating calculus or calculi in a human body by using microexplosives.

In order to disintegrate relatively large sized calculus by using this type of an apparatus, it is necessary to eliminate the bad effects caused by a large explosive; this can be achieved by using more than 100 small microexplosives which are intermittently exploded to disintegrate the calculus in small portions, while minimizing any bad effects on the human body.

Additionally, it is desirable to facilitate the feeding and charging of a large number of microexplosives in an intermittent fashion into the apparatus.

SUMMARY OF THE INVENTION

Accordingly, the present invention has as a general object to provide an apparatus which can overcome the deficiencies of prior art devices and which is relatively simple to construct.

The present invention in one aspect is thus achieved by providing an apparatus which comprises a carrying member for one or more explosive capsules; the carrying member is movable and carries a plurality of explosive capsules which are separable from the carrying member. The apparatus includes a pair of explosive capsule holding rods which hold individual explosive capsules to be exploded, a driving member to drive one of the two holding rods so that each selected capsule will be held between the two rods and will be separated from the carrying member and moved to a predetermined position where it will be exploded, and a striking member for striking one of the holding rods in a longitudinal direction so that an explosive held in the capsule between the two holding rods will be provided with a detonating impact.

In a second aspect, the present invention provides for an intermittent explosion apparatus adapted to receive a movable explosive capsule carrying member to which a plurality of explosive capsules are separably connected. The explosion apparatus comprises first and second explosive capsule holding rods for holding one of the plurality of explosive capsules between said rods, means for driving one of said two holding rods towards the other of said rods so as to retain each said capsule between the two holding rods, said driving means comprising means for separating each said capsule from said carrying member and for moving each said capsule to a predetermined position for detonation. The apparatus further comprises means for striking one of the holding rods in the direction of the axis of said rod so that an explosive within each said capsule which is held between the two holding rods will be impacted and exploded.

The intermittent explosion apparatus can be combined with the explosive capsule carrying member, said carrying member comprising first and second elongated base members, said plurality of explosive capsules being positioned at regularly spaced intervals between said first and second elongated base members, each of said capsules being connected to said two base members by a first attachment member extending inwardly from said first base member and by a second attachment member extending inwardly from said second base member.

Each of said elongated base members includes a row of a plurality of concave recessed portions spaced at regular intervals along an upper surface of the base members, with the concave portions being adapted to mesh with teeth on at least one gear forming a part of said apparatus, said gear being driven by a motor.

The explosion apparatus further comprises a machine body having an upper surface, said carrying member being adapted to be positioned on said upper surface, said machine body including a shock wave generating chamber therein and a bore communicating said chamber with said upper surface of said body, wherein at least one of said holding rods is movable in a substantially vertical position within said bore, the axis of said two rods being substantially aligned, the second of said holding rods being upwardly biased by a spring located within a lower bore of said machine body.

The shock wave generating chamber includes an inner wall having at least part of its shape in the form of a pseudo-ellipsoid of revolution, and the predetermined position to which each of said explosive capsules is moved is a first focus point of said pseudo-ellipsoid of revolution.

In yet another aspect, the present invention discloses a carrying belt for supporting a plurality of explosive capsules which comprises first and second base members, each of said base members having an upper surface, a lower surface, an inner wall, and an outer wall, wherein said base members are spaced apart from each other in a substantially parallel fashion with the respective inner walls of said base members facing each other. A plurality of capsules are adapted to receive explosive charges, said capsules being positioned between said first and second base members. A plurality of pairs of fixing members each comprise a first fixing member attached at a first end to the inner wall of said first base member and attached at its second end to an outer wall of said capsule, the second fixing member in each pair being attached at a first end to the inner wall of said second base member and attached at a second end to said exterior wall of said capsule. Each of said capsules is generally cylindrical and contains an explosive charge sealed therein.

Each of said fixing members comprises a generally cylindrical rod which is frangibly connected at its second end to one of said capsules.

The capsules are spaced from each other by a predetermined distance along a longitudinal axis of said belt, said belt further comprising a plurality of reinforcing members, each of said reinforcing members having a first end attached to an inner wall of said first base member and a second attached to an inner wall of said second base member. Each of said reinforcing members is substantially rod-like, and respective reinforcing members are positioned between adjacent capsules.

A plurality of equally spaced recesses are provided on the upper surface of each of said first and second base members, with such recesses comprising means for engaging respective teeth of a gear and means for moving said belt along the upper surface of an apparatus on which it is positioned.

In a still further aspect, the present invention provides an explosion apparatus adapted to receive a movable explosive capsule carrying or support belt to which a plurality of explosive capsules are separably attached in a predetermined spaced relationship. The apparatus comprises a main body portion having an upper surface, a shock wave generating chamber located on the interior of said machine body, means for engaging and moving said explosive capsule carrying belt along the upper surface of said main body, means for separating individual explosive capsules from said capsule carrying belt and means for moving said separated capsules from said upper surface of said main body into said chamber, and means for striking said separating means to impact and explode said explosive capsules when the capsules are positioned within said chamber. The main body includes an upper bore connecting said upper surface of said main body to said explosive chamber and a lower bore connected to a lower wall of the chamber.

The means for detaching said explosive capsule from said support belt and for moving said explosive capsule into said shock wave generating chamber comprises an upper capsule holding rod slidably positioned within said upper bore and a lower capsule holding rod slidably positioned within said lower bore, said lower capsule holding rod being biased upwardly by a spring positioned around said rod and within said lower bore. The chamber is defined by an inner wall, at least a portion of said inner wall having the shape of a pseudo-ellipsoid of revolution. The apparatus further comprises an immersion tank adapted to hold a human body, said immersion tank being positioned directly adjacent to said shock wave generating chamber.

The means for moving said support belt along said upper surface of said main body comprises a stepping motor and two spaced gears driven by said stepping motor in a rotatable fashion, said gears having a plurality of teeth which are adapted to engage recesses in an upper surface of said capsule support member to drive said support member across said upper surface of said machine body.

The separating means comprise an upper rod and the means for striking said upper rod comprise a substantially L-shaped strike member which is spring biased, said striking member having a recessed portion at one end thereof, a restraining member having a hook at one end which is adapted to engage said striking member and retain said striking member in an inoperative position, and means for pushing said restraining member to pivot so that said hook on said restraining member will disengage said strike member recessed portion, said strike member spring comprising means for biasing said strike member into a position in which it impacts upon an upper end of said upper holding rod to force said holding rod downwardly to impact upon an explosive capsule and detonate said capsule when in said chamber.

The intermittent explosion apparatus further comprises a rotatable disk having a pin protruding outwardly therefrom, said pin comprising means for engaging said strike member and moving it from its operative position back to its inoperative position so that said recessed portion of said strike member will become reengaged by said restraining member.

The means for detaching and moving said explosive capsules into said shock wave generating chamber further comprise a substantially fork-shaped yoke gripping an upper portion of said upper rod, said fork-shaped yoke being connected to a stepping motor via a pinion, a rack and a connecting rod member attached to said yoke, whereby said yoke moves said rod downwardly when said stepping motor is moved in a first predetermined direction.

In yet another aspect, the present invention provides a method of successively exploding a plurality of exploding charges within a shock wave generating chamber; the method comprises intermittently moving a plurality of explosive capsules attached to an explosive capsule support member over the main body of an intermittent explosion apparatus, separating individual explosive capsules from said support member, moving said individual capsules from an upper surface of said main body into a shock wave generating chamber within said main body, and detonating each of said explosive capsules by impacting said explosive capsules.

The step of moving the explosive capsules in an intermittent fashion over the upper surface of said main body of said apparatus comprises driving the support member carrying said capsules in spaced relationship by engaging rotating gears driven by a stepping motor with recesses in an upper surface of said belt.

The step of separating said explosive capsules from said explosive capsule support member comprises pushing individual capsules downwardly with a generally vertically extending pushing rod which is adapted to be moved downwardly by a fork-shaped yoke connected to a stepping motor. The rod is moved downwardly beyond the point at which it separates each said capsule from said belt through a bore in the main body of said apparatus and into said shock wave generating chamber. Each of said capsules is exploded by impacting an upper end of said upper rod member with a spring biased hammer element.

BRIEF DESCRIPTION OF THE DRAWINGS

The above and other objects, features and advantages of the present invention will be more fully described in detail herein with reference to the accompanying drawings, in which like reference numerals describe like parts throughout, and wherein.

DETAILED DESCRIPTION OF THE DRAWINGS

Figure 1:
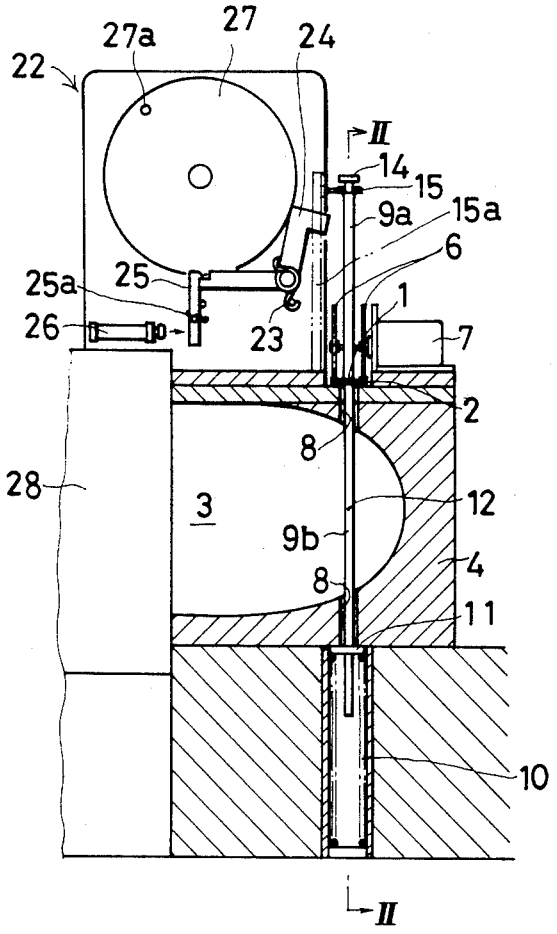
FIG. 1 is a sectional plan view of one embodiment of the present invention when in its inoperative condition.
Figure 4:
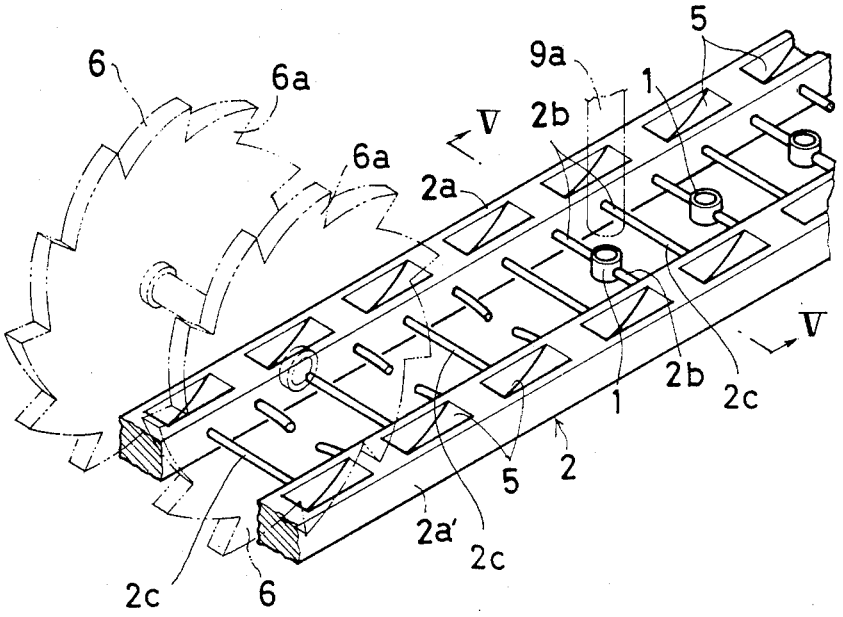
FIG. 4 is a perspective view of an explosive capsule carrying belt and gears for driving the belt.
Figure 5:
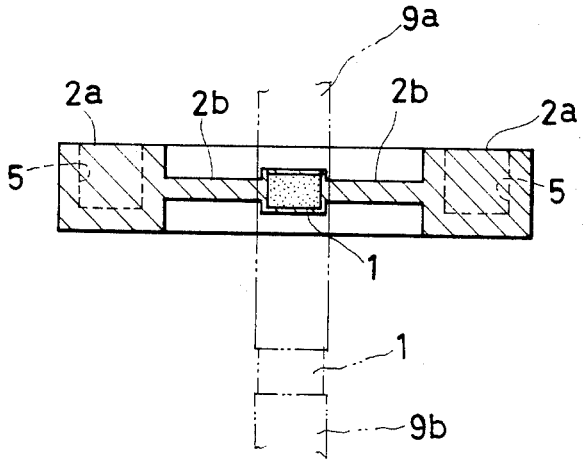
FIG. 5 is a sectional view taken along line V—V in FIG. 4.

FIG. 1 illustrates an apparatus for exploding a plurality of explosive capsules 1. Each explosive capsule is open at its upper surface; in one embodiment, the capsule is generally cylindrical and has an outer diameter of approximately 3 mm., an inner diameter of approximately 2.5 mm., and a height of approximately 2 mm. An explosive carrying belt 2 is best illustrated in FIG. 4, and is adapted to carry a predetermined plurality of explosive capsules 1. The capsules are preferably formed from a synthetic resin, aluminum, or similar material; and carrying member or belt 2 can be integrally formed from the same material as the capsules. In this fashion, the capsules and the carrying member can be formed integrally so as to form a belt having a total width of approximately 22 mm., as best seen in FIG. 4.

Carrying member 2 comprises a left-hand base member 2a and a right-hand base member 2a' which are spaced from each other over a predetermined distance, e.g., 12 mm. Each of the members can have, e.g., a thickness of approximately 4 mm, and a width of approximately 5 mm. The plurality of capsules 1 are disposed in a spaced relationship and in an aligned fashion so as to provide a predetermined space between each successive capsule and between the outer diameter of the capsules and the respective inner walls of each of the base members 2a and 2a'. Each capsule is connected to the base members by a pair of attachment rods 2b, as well illustrated in FIG. 4. Each of the attachment rods is approximately 1 mm. in diameter and is attached to an inner wall of each of the base members, with each attachment rod being connected to an inner wall of one respective base member. At their inner ends, the rods are attached to the exterior surface of each cylindrical capsule 1, again as illustrated in FIG. 4. A plurality of regularly spaced reinforcing members 2c are provided in spaced relationship between the base members, with one end of each member 2c being connected to an inner wall of base member 2a and the other end being attached to an inner wall of base 2a'. These spacing members reinforce the belt structure and can be provided, as shown in FIG. 4, in an interposed relationship with respect to the capsules and the attachment rods.

Figure 2:
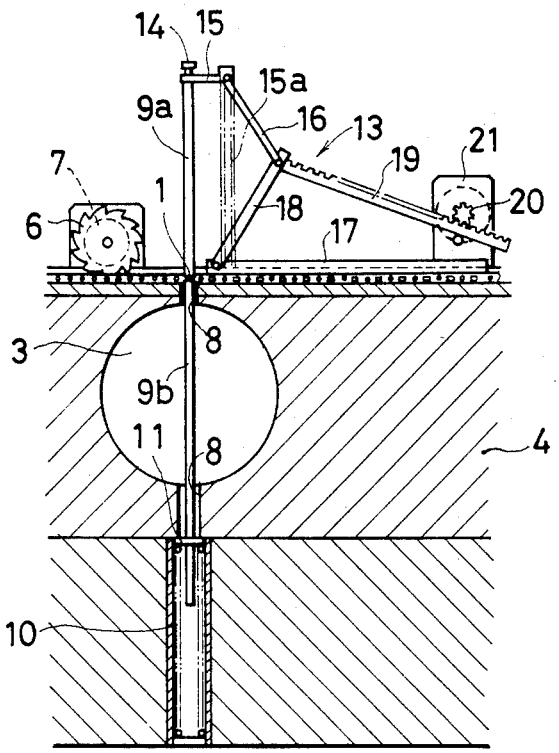
FIG. 2 is a sectional view of the apparatus of FIG. 1 taken along line II—II of FIG. 1.

Carrying member 2 is adapted to be placed in a movable fashion along the upper surface of machine body 4, as best illustrated in FIG. 2. The apparatus body 4 includes a shock wave generating chamber 3 having an interior surface in the shape of a pseudo ellipsoid of revolution. Each of the base members of belt or carrier 2 are provided with a plurality of recessed or concave portions 5 on their upper surfaces which are spaced at predetermined intervals. The machine body is associated with the belt by means of two rotatable gears 6 (see FIG. 4) having teeth 6a which are adapted to engage the recessed portions 5 on the belt and drive the belt when the gears are rotated. The gears are rotated by an electric motor 7 so that the entire belt can be moved along the upper surface of machine body 4. Right-hand and left-hand gears 6 are provided, as shown in FIG. 4, to simultaneously drive the connected base members 2a and 2a'. Machine body 4 is provided with a through bore 8 which has a first portion which extends vertically from an upper surface of chamber 3 and a second portion below shock wave generating chamber 3. An upper explosive capsule holding rod 9a (see FIG. 1) is held in a generally vertical movable fashion within the upper portion of opening or bore 8, and a lower explosive capsule holding rod 9b, which is urged upwardly by a spring 10, is slidably inserted in a lower portion of opening 8 and is limited in its upward movement by a stop element 11. In this manner, the upper end of rod 9b will be able to go no further than to contact a lower surface of carrying belt 2, as seen in FIG. 1.

Upper holding rod 9a is attached to a driving apparatus 13 so that when it is driven by the driving apparatus the holding rod will contact a selected explosive capsule 1 and maintain the capsule between the upper and lower holding rods. If further driven by the upper holding rod 9a, each capsule will be separated by a shearing force from carrying member 2, i.e., it will be directly separated from rods 2b, and will be further moved into a predetermined position within shock wave generating chamber 3. More specifically, the movement of rod 9a downwardly will force the selected capsule 1 into a first focus position 12 of chamber 3 having a part of its wall surface in the form of a pseudo-ellipsoid of revolution. This will permit the detonation of each explosive to generate shock waves directed at calculus (i) in a human body positioned at the other focal point of the ellipsoid.

Driving apparatus 13 is best illustrated in FIG. 2. It comprises a connecting rod member 16 having one end pivotally connected to a fork- or yoke-shaped member 15 and a second end attached to rod 18 and to rack 19 at a pivot point. Fork member 15 is engaged with a relatively small diametrical portion of an upper end portion of holding rod 9a; the yoke- or fork-shaped member 15 is supported so that it can be movable upwardly and downwardly along a slot in guide member 15a, which is illustrated in dashed lines in FIG. 2; and rod 18, which is pivotally attached at one end to rod 16 and at its other end to a base member 17, is also connected at the point at which it is attached to rod member 16 to one end of rack 19. The rack is connected, via pinion 20 and a gear (not illustrated or referenced), to an electric motor 21.

Figure 3:
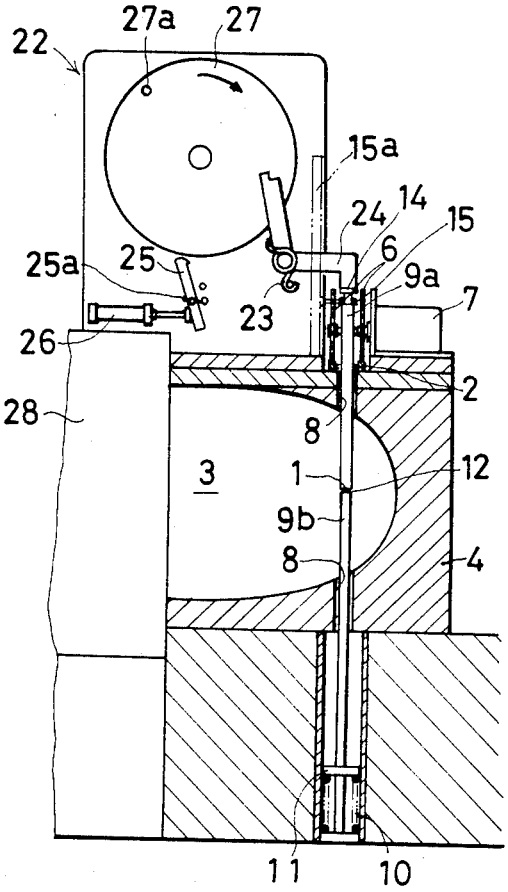
FIG. 3 is a sectional view similar to the apparatus of FIG. 1, but illustrating the apparatus when in its operative position.

The electric motor can comprise, e.g., a stepping motor, and each time that it rotates it will move holding rod 9a downwardly by a predetermined distance from the inoperative position illustrated in FIG. 1 to the operative position illustrated in FIG. 3. Each time that motor 21 turns in the reverse direction, it moves holding rod 9a upwardly by a similar predetermined incremental distance, from the position of FIG. 3 to the inoperative position of FIG. 1.

A striking apparatus 22, as best illustrated in FIGS. 1 and 3, is provided to selectively strike an upper end of holding rod 9a when the rod is in the operative position illustrated in FIG. 3. Striking apparatus 22 includes a spring biased L-shaped striking member 24, a restraining member 25 which has a hook which is adapted to be positioned in a notch or recess at a rear end of striking member 24, with restraining member 25 being urged by spring 25a to restrain striking member 24 in a "ready" position. A pushing member 26 is adapted to push restraining member 25 in the direction of the arrow of FIG. 1; and a return member 27 having an engaging pin 27a is in the form of a disk which is adapted to return striking member 24 to the noted ready position. Push member 26 comprises a piston cylinder or similar member, and when it is operated to pivot restraining member 25 so that the hook and recess disengage, the striking apparatus 22 changes from its inoperative position and condition of FIG. 1 to the operative condition and position of FIG. 3. Similarly, if a limit switch (not shown in the drawings) is closed, returning member 27 is rotated in the direction of the arrow illustrated in FIG. 3 to return the striking apparatus 22 in to its inoperative position and condition of FIG. 1, by virtue of pin 27a engaging the recess on member 24 and moving it leftwardly.

Electric motor 7, which is used to move carrying member or belt 2, can comprise, e.g., a stepping motor. In this fashion, each time that the motor is operated, carrying member 2 will be moved by one pitch of explosive capsules 1, i.e., each time it is moved the next successive capsule will be indexed or advanced to a position in which it is adapted to be struck by operating rod 9a. Each starting operation is initiated by a limit switch (not illustrated in the drawings) which is closed each time that holding rod 9a reaches the position illustrated in FIG. 1.

A liquid tank 28 is positioned directly adjacent to machine body 4 and is in communication with the shock wave generating chamber 3; this liquid tank retains a human body which is immersed and which will be treated by the shock waves generated in chamber 3 as a result of the detonation of each microexplosive capsule 1.

The operation of the embodiment of the invention illustrated in the drawings will now be discussed. Before carrying member or belt 2 is positioned on the upper surface of machine body 4, each explosive capsule 1 is charged with an explosive material, and an upper surface of each capsule body is tightly closed or sealed with a coating of quick-drying paste or adhesive to ensure that the explosive material will be retained within the capsule. Thereafter, the carrying member or belt 2 is positioned on the upper surface of machine body 4.

Each capsule 1 is positioned in the space located between elongated base members 2a and 2a' of carrying member 2 so that each capsule is attached to the base members by attachment rods 2b, as discussed previously; these rods act as shock isolation mountings to prevent the explosive capsule from being accidentally exploded by any shock which might occur during conveyance of belt 2.

From the position of the apparatus of FIG. 1, if electric motor 21 is driven in a normal fashion, rack 19 will be moved rightwardly (see FIG. 2) and fork-shaped yoke member 15 will be moved downwardly along guide 15a, via its connection with rod members 16 and 18; in this fashion, holding rod 9a will be pushed downwardly by the yoke 15. As a result, this upper holding rod will be brought into contact with the explosive capsule 1 which is then positioned below the rod and above bore 8, and as a result the capsule will be held between upper rod 9a and lower holding rod 9b. If holding rod 9a is further lowered, the connecting portions 2b which connect capsule 1 to base members 2a and 2a' will be sheared, so that the capsule will be separated from carrying member 2, and will be thereafter introduced into shock wave generating chamber 3 (under further downward movement of the rods) so that it is held firmly between holding rods 9a and 9b.

As each successive capsule 1 reaches the focus position 12 which is illustrated in FIG. 3, the operation of electric motor 21 will be terminated, and the movement of holding rods 9a and 9b will also terminate. If, at this stage, cylinder 26 is advanced to push the bottom portion of restraining member 25, the restraining member will pivot about point 25a and the hook on the upper portion of the restraining member will become disengaged from the recess of striking member 24. At this time, striking member 24 will rotate under the biasing force of spring 23 and will serve to strike the upper end of holding rod 9a.

The impact applied to holding rod 9a by this striking operation is then transmitted to the explosive in capsule 1, and the explosive contained therein is thereby detonated. This explosion will generate a shock wave which is reflected by the wall surface of chamber 3 and which, as a result of the configuration of the wall chamber, is focused on the second focus position which is in liquid tank 28. In this fashion, the calculus in the human body set in position at the second focus position in liquid tank 28 will begin to be broken.

Thereafter, electric motor 21 is turned in the reverse direction, thereby returning holding rod 9a upwardly into the original position which it occupied; and striking apparatus 22 is also returned to its original, inoperative and ready position under the rotation of returning member or disk 27. In this position, when electric motor 7 begins to operate, carrying member 2 will again be moved, i.e., indexed, by one pitch, and the next explosive capsule 1 will be positioned in alignment with the axes of support rods 9a and 9b.

Repetition of this operation will effect explosion of the next capsule 1 located on belt 2.

In the embodiment illustrated in the drawings, lowering movement of holding rod 9a, elevation of this rod, and advancing of cylinder 26 are all initiated, respectively, by manual operation. The present invention contemplates, however, that a limit switch could be provided which would be closed when holding rod 9a reaches its lower limit position; a timer switch could be responsive to the limit switch so that even if lowering movement of holding rod 9a was initiated by a manual operation, the remaining operations in the process of exploding the explosive charge within the chamber could be performed automatically.

Additionally, in the embodiment illustrated, the apparatus is used to disintegrate calculus in a human body, but could be similarly applied to any other apparatus which needs to use a shock wave, e.g., a molding or similar apparatus.

Thus, in accordance with the present invention, a plurality of explosive capsules are carried on a carrying member and are arranged to be moved in individual successive fashion to a predetermined position where they are moved downwardly into an explosion chamber and exploded.

Although the present invention has been described with respect to one specific embodiment thereof, it is apparent that obvious modifications and equivalent structures could be used to achieve the purposes set forth herein.

What is claimed is:

1. An intermittent explosion apparatus adapted to receive a movable explosive capsule carrying member to which a plurality of explosive capsules are separably connected, said explosion apparatus comprising first and second explosive capsule holding rods capable of holding one of the plurality of explosive capsules between said rods, means for driving one of said two holding rods towards the other of said rods so as to retain each said capsule between the two holding rods, said driving means comprising means for separating each said capsule from said carrying member and for moving each said capsule to a predetermined position for detonation, said apparatus further comprising means for striking one of said holding rods in the direction of the axis of said rod so that an explosive within each said capsule which is held between the two holding rods will be impacted and exploded.

2. An intermittent explosion apparatus in accordance with claim 1, in combination with said explosive capsule carrying member, said carrying member comprising first and second elongated base members, said plurality of explosive capsules being positioned at regularly spaced intervals between said first and second elongated base members, each of said capsules being connected to said two base members by a first attachment member extending inwardly from said first base member and by a second attachment member extending inwardly from said second base member.

3. An apparatus in accordance with claim 2, wherein each of said elongated base member includes a plurality of recessed portions spaced at regular intervals along one surface of said base member, said concave portions being adapted to mesh with teeth on at least one gear forming a part of said apparatus, said gear being driven by a motor.

4. An intermittent explosion apparatus as defined in claim 1 which further comprises a machine body having an upper surface, said carrying member being adapted to be positioned on said upper surface, said machine body including an internal shock wave generating chamber therein and a bore communicating said chamber with said upper surface of said body, wherein at least one of said holding rods is movable in a substantially vertical position within said bore, the axes of said two rods being substantially aligned, the second of said holding rods being upwardly biased by a spring located within a lower bore in said machine body.

5. An intermittent explosion apparatus in accordance with claim 4, wherein said shock wave generating chamber includes an inner wall having at least part of its shape in the form of a pseudo-ellipsoid of revolution.

6. An intermittent explosion apparatus in accordance with claim 5 wherein the predetermined position to which each of said explosive capsules is positioned is a first focus point of said pseudo-ellipsoid of revolution.

7. A carrying belt for supporting a plurality of explosive capsules, said belt comprising:

(a) first and second base members, each of said base members having an upper surface, a lower surface, an inner wall, and an outer wall, wherein said base members are spaced apart from each other in a substantially parallel fashion with the respective inner walls of said base members facing each other;

(b) a plurality of capsules which are adapted to receive explosive charges, said capsules being positioned in a spaced relationship between said first and second base members; and (c) a plurality of pairs of attachment members, each of said pairs comprising a first attachment member attached at a first end to the inner wall of said first base member and attached at a second end to an outer wall of said capsule, said second attachment member being attached at a first end to the inner wall of said second base member and attached at a second end to said exterior wall of said capsule.

8. A support belt in accordance with claim 7 wherein each of said capsules is generally cylindrical and contains an explosive charge sealed therein.

9. A support belt in accordance with claim 7 wherein each of said attachment members comprises a generally cylindrical rod which is frangibly connected at its second end to one of said capsules.

10. A support belt in accordance with claim 7, wherein said capsules are spaced from each other by a predetermined distance along a longitudinal axis of said belt, said belt further comprising a plurality of reinforcing members, each of said members having a first end attached to an inner wall of said first base member and a second attached to an inner wall of said second base member.

11. An intermittent explosion apparatus in accordance with claim 10 wherein each of said reinforcing members is substantially rod-like and wherein each reinforcing member is positioned between adjacent capsules.

12. A support belt in accordance with claim 7 wherein a plurality of equally spaced recesses are provided on the upper surface of each of said first and second base members, said recesses comprising means for engaging respective teeth of a gear and means for moving said belt along the upper surface of an apparatus on which it is positioned.

13. An explosion apparatus adapted to receive a movable explosive capsule support belt to which a plurality of explosive capsules are separably attached in a predetermined spaced relation, said apparatus comprising:

(a) a main body portion having an upper surface;

(b) a shock wave generating chamber located on the interior of said body portion;

(c) means for engaging and moving said explosive capsule carrying belt along said upper surface of said main body;

(d) means for separating individual explosive capsules from said capsule carrying belt and means for moving said separated capsules from said upper surface of said main body into said chamber; and (e) means for striking said separating means to impact and explode said explosive capsules when said capsules are positioned within said chamber.

14. An intermittent explosion apparatus in accordance with claim 13 wherein said main body includes an upper bore connecting said upper surface of said main body to said explosive chamber and a lower bore connected to a lower wall of said explosive chamber.

15. An intermittent explosion apparatus in accordance with claim 14 wherein said means for detaching said explosive capsules from said support belt and for moving said explosive capsules into said shock wave generating chamber comprises an upper capsule holding rod slidably positioned within said upper bore and a lower capsule holding rod slidably positioned within said lower bore, said lower capsule holding rod being biased upwardly by a spring positioned around said rod and within said lower bore.

16. An intermittent explosion apparatus in accordance with claim 13 wherein said chamber is defined by an inner wall, at least a portion of said inner wall having the shape of a pseudo-ellipsoid of revolution.

17. An intermittent explosion apparatus in accordance with claim 16 further comprising an immersion tank adapted to hold a human body, said immersion tank being positioned directly adjacent to said shock wave generating chamber.

18. An intermittent explosion apparatus in accordance with claim 13 wherein said means for moving said support belt along said upper surface of said main body comprises a stepping motor and two spaced gears driven by said stepping motor in a rotatable fashion, said gears having a plurality of teeth which are adapted to engage recesses in an upper surface of said capsule support member to drive said support member across said upper surface of said machine body.

19. An intermittent explosion apparatus in accordance with claim 13 wherein said separating means comprise an upper rod and wherein said means for striking said upper rod comprise a substantially L-shaped strike member which is biased by a spring, said strike member having a recessed portion at a rear end thereof, said apparatus further comprising a restraining member having a hook at one end which is adapted to engage said striking member recessed portion and to retain said striking member in an inoperative position, and means for pushing said restraining member to pivot so that said hook on said restraining member will disengage said strike member, said strike member spring comprising means for biasing said strike member into a position in which it impacts upon an upper end of said upper holding rod to force said holding rod downwardly to impact upon an explosive capsule and to detonate said capsule when in said chamber.

20. An intermittent explosion apparatus in accordance with claim 19 further comprising a rotatable disk having a pin protruding outwardly therefrom, said pin comprising means for engaging said strike member and moving it from its operative position back to its inoperative position so that said recessed portion of said strike member will be reengaged by said restraining member.

21. An intermittent explosion apparatus in accordance with claim 15 wherein said means for detaching and moving said explosive capsules into said shock wave generating chamber further comprise a substantially fork-shaped yoke gripping an upper portion of said upper rod, said fork-shaped yoke being connected to a stepping motor via a pinion, a rack and a connecting rod member being attached to said yoke, whereby said yoke moves said connecting rod downwardly when said stepping motor is moved in a first predetermined direction.

22. A method of successively exploding a plurality of exploding charges within a shock wave generating chamber, said method comprising:

(a) intermittently moving a plurality of explosive capsules attached to an explosive capsule support member over the main body of an intermittent explosion apparatus;

(b) separating individual explosive capsules from said support member;

(c) moving said individual capsules from an upper surface of said main body into a shock wave generating chamber within said main body; and (d) detonating each of said explosive capsules by impacting said explosive capsules.

23. A method in accordance with claim 22 wherein the step of moving said explosive capsules in an intermittent fashion over the upper surface of said main body of said apparatus comprises driving a belt carrying said capsules in spaced relationship by engaging teeth rotating gears driven by a stepping motor with recesses in an upper surface of said belt.

24. A method in accordance with claim 22 wherein said step of separating said explosive capsules from said explosive capsule support member comprises pushing said capsules downwardly with a generally vertically extending pushing rod which is adapted to be moved downwardly by a fork-shaped yoke connected to a stepping motor.

25. A method in accordance with claim 24 wherein said rod is moved downwardly beyond the point at which it separates each said capsule from said belt through a bore in said main body of said apparatus and into said shock wave generating chamber.

26. A method in accordance with claim 25 wherein each of said capsules is exploded by impacting on an upper end of said rod with a spring biased actuator.

* * * * *